US010928155B2

(12) United States Patent
Wasilewski et al.

(10) Patent No.: US 10,928,155 B2
(45) Date of Patent: Feb. 23, 2021

(54) ARCHERY BOW GRIP SYSTEM

(71) Applicant: Hoyt Archery, Inc., Salt Lake City, UT (US)

(72) Inventors: Donald Wasilewski, Powell, WY (US); Joshua Moore, Stansbury Park, UT (US)

(73) Assignee: HOYT ARCHERY, INC., Salt Lake City, UT (US)

( * ) Notice: Subject to any disclaimer, the term of this patent is extended or adjusted under 35 U.S.C. 154(b) by 0 days.

(21) Appl. No.: 16/158,026

(22) Filed: Oct. 11, 2018

(65) Prior Publication Data

US 2020/0116451 A1 Apr. 16, 2020

(51) Int. Cl.
*F41B 5/14* (2006.01)

(52) U.S. Cl.
CPC ..... *F41B 5/1403* (2013.01)

(58) Field of Classification Search
CPC ..... F41B 5/00; F41B 5/10; F41B 5/14; F41B 5/1403
USPC ..... 124/23.1, 86, 88
See application file for complete search history.

(56) References Cited

U.S. PATENT DOCUMENTS 3,407,799 A * 10/1968 Bennett ..... F41B 5/0005 124/88
3,538,902 A * 11/1970 Fowkes ..... F41B 5/0031 124/88
3,599,621 A * 8/1971 Scrobell ..... F41B 5/0031 124/23.1
4,124,014 A * 11/1978 Darlington ..... F41B 5/10 124/88
4,175,536 A * 11/1979 Carella ..... F41B 5/14 124/23.1
4,252,100 A * 2/1981 Rickard ..... F41B 5/10 124/23.1
4,457,287 A * 7/1984 Babington ..... F41B 5/10 124/23.1
4,881,514 A * 11/1989 Denslow ..... F41B 5/0005 124/88
4,966,124 A * 10/1990 Burling ..... F41B 5/14 124/23.1
5,241,945 A * 9/1993 Shepley, Jr. ..... F41B 5/0031 124/23.1
5,243,958 A * 9/1993 Shepley, Jr. ..... F41B 5/0031 124/23.1
5,469,834 A * 11/1995 Higgins ..... F41B 5/14 124/23.1
5,551,413 A * 9/1996 Walk ..... F41B 5/14 124/23.1
5,615,663 A * 4/1997 Simonds ..... F41B 5/14 124/23.1

(Continued)

*Primary Examiner* — Alexander R Niconovich
(74) *Attorney, Agent, or Firm* — Dorsey & Whitney LLP

(57) ABSTRACT

An adjustable grip system includes a plate having at least one grip adjustment aperture and a fastener, which is configured to extend through the grip adjustment aperture. The plate is attachable to the handle portion by the fastener at a plurality of laterally spaced apart positions. The plate or riser can have at least one riser mating protrusion insertable into at least one grip mating recess to retain the grip to the riser assembly. The grip can be laterally adjustable to control torques and forces applied to the bow by the hand of the archer when shooting a projectile.

23 Claims, 10 Drawing Sheets

(56) References Cited

U.S. PATENT DOCUMENTS

| | | | | | |
|---|---|---|---|---|---|
| 5,842,460 | A * | 12/1998 | Barber | F41B 5/14 | 124/88 |
| 6,662,798 | B1 * | 12/2003 | Johnson | F41B 5/0005 | 124/88 |
| 6,988,495 | B1 * | 1/2006 | Van Hoorn | F41B 5/14 | 124/88 |
| 8,033,274 | B2 * | 10/2011 | Pedemonte | F41B 7/04 | 124/20.3 |
| 8,783,239 | B2 * | 7/2014 | Vyprachticky | F41B 5/14 | 124/88 |
| 9,417,027 | B2 * | 8/2016 | Meilak | F41B 5/1426 | |
| 9,702,656 | B2 * | 7/2017 | Vyprachticky | F41B 5/1403 | |
| 9,752,843 | B2 * | 9/2017 | Garver | F41B 5/1403 | |
| 10,126,091 | B2 * | 11/2018 | Wendelburg | F41B 5/1403 | |
| 10,648,760 | B2 * | 5/2020 | Gold | F41B 5/1403 | |
| 10,648,761 | B1 * | 5/2020 | Elezar | F41B 5/1403 | |
| 2015/0211825 | A1 * | 7/2015 | Chang | F41B 5/1403 | 124/23.1 |

* cited by examiner

ARCHERY BOW GRIP SYSTEM

TECHNICAL FIELD OF THE INVENTION

The present disclosure generally relates to riser assemblies for archery bows and specifically relates to mountable and adjustable hand grips for archery bows.

BACKGROUND OF THE INVENTION

Skilled archers desire equipment that is accurate and consistent. To this end, archers regularly tune or otherwise adjust their bows for optimum performance. Tuning a bow involves manipulating the draw weight, draw length, cable lengths, or otherwise adjusting the components of the bow to minimize the effect of undesired forces on the arrow as it is shot from the bow.

Archery bows include a grip attached to the riser that interfaces with the archer's palm while shooting an arrow from the bow. Grips can be integrated into the riser or attached to the riser as a separate fastened or bonded component. Grips that are attached to the riser separately can have a wide array of shapes, sizes, and materials to accommodate the needs of the archer. For example, one grip may be wider than another and a second grip may contact less surface area on the archer's palm than another grip. Other grips may have an enlarged lower portion to angle the archer's wrist while using the bow.

The way in which the archer's hand contacts the grip and the force an archer uses to grasp the bow can cause the riser to rotate (sometimes referred to as bow torque) during the shot and can lead to inconsistent and unpredictable arrow flight. Even if the archer is inducing minimal torque through the grip, an archer may encounter other issues during the shot that affects arrow flight. For example, one or both of the wheels (i.e., cams) may lean slightly off axis which may cause issues when the bow is shot. As another example, a bow riser might become bent when a bowhunter falls or drops the bow in the field.

Some archers adjust their arrow rests laterally to accommodate for the torque induced on the riser when the bow is shot. Arrow rests, however, have limited adjustable range depending on the style of arrow rest being used and the shape of the arrow shelf of the bow. Thus, adjusting the arrow rest of the bow may fail to adequately remedy issues related to arrow flight caused by torque.

In view of the foregoing and other issues, there is a need for improvements to archery equipment including grips and riser assemblies.

BRIEF SUMMARY OF THE INVENTION

According to an aspect of the present disclosure, an archery bow may be provided. The bow may comprise a riser assembly having an upper end, a lower end, and at least one riser mating protrusion extending laterally from a handle portion of the riser assembly relative to a center plane of the handle portion. The bow may also include a grip having a riser contacting surface. The riser contacting surface may have at least one grip mating recess configured to receive the riser mating protrusion of the riser assembly to retain the grip to the riser assembly. The bow may also have upper and lower limbs, each having a proximal end and a distal end, with each proximal end being connected to the riser. A bow string may extend between the upper limb and the lower limb.

The grip mating recess may be an elongated slot and the riser mating protrusion extending laterally from the handle portion may be an elongated flange receivable by the elongated slot. The grip mating recess may also span a length equal to the length of the riser mating protrusion. The riser assembly may have a plurality of riser mating protrusions positioned on opposite sides of the center plane of the handle portion. In some cases, the riser assembly may also include a plate which may be attachable to the handle portion. The plate may have at least one riser mating protrusion protruding laterally from a centerline of the plate configured to be received by at least one grip mating recess to retain the grip to the riser assembly.

In another aspect, an adjustable riser assembly for an archery bow is shown and described. The assembly may comprise a riser having an upper end, a lower end, and a handle portion positioned between the upper end and lower end of the riser. The assembly may also include a plate having at least one grip adjustment aperture. The assembly may further include a fastener configured to extend through the grip adjustment aperture of the plate to attach the plate to the handle portion. The plate may be attachable to the handle portion by the fastener at a plurality of laterally spaced apart positions. The assembly may also have a grip attachable to the plate.

The plate may comprise a centerline. In a first position of the laterally spaced apart positions, the centerline may be offset from a center plane of the handle portion in a first direction. In a second position of the laterally spaced apart positions, the centerline may be offset from the center plane of the handle portion in a second direction. The second direction may be opposite from the first direction. The grip adjustment aperture may consist of an elongate slot extending across a centerline of the plate. The adjustable riser assembly may also include a second fastener, wherein the first and second fasteners may be configured to extend through separate grip adjustment apertures. The centerline of the plate may be parallel to the center plane of the handle portion. The plate may include at least one lateral protrusion and the grip may include at least one grip recess configured to receive the lateral protrusion to retain the grip to the plate.

In another embodiment, a method of adjusting an archery bow grip is provided. The method may comprise providing a riser for an archery bow, the riser having a handle portion and a center plane. The method may further comprise mounting a plate to the handle portion using a fastener, the fastener extending through the plate at one of a plurality of positions relative to the plate. The plate may be mounted at one of a plurality of lateral positions relative to the center plane of the handle portion. The method may also include attaching a grip to the plate.

In some cases, the centerline of the plate in a first lateral position for mounting the plate and the centerline of the plate in a second lateral position for mounting the plate may be positioned on opposite sides of the center plane. In other cases, one lateral position for mounting the plate and another lateral position for mounting the plate may be positioned on the same side of the center plane. The centerline of the plate may remain parallel to the center plane of the handle portion when the plate is mounted to the handle portion of the riser. The plate may be mounted to the handle portion of the riser such that the centerline of the plate is laterally spaced or offset from the center plane of the handle portion. The plate may be mountable to the handle portion of the riser using a single fastener extended through one of a plurality of apertures in the plate. Alternatively, the plate may be mountable to the handle portion of the riser using a plurality of fasteners extended through a plurality of apertures in the plate. The plate may also include at least one lateral protrusion protruding laterally from the center plane of the riser and the grip may also include at least one grip recess configured to receive the lateral protrusion of the plate to attach the grip to the plate. In some embodiments, attaching the grip to the plate may include extending a fastener through the grip and receiving the fastener within the plate. In some embodiments, the plate may be mounted to the handle portion at one of an infinite number of laterally different positions relative to the handle portion.

The above summary of the present invention is not intended to describe each embodiment of every implementation of the present invention. The figures and the detailed description that follow more particularly exemplify a preferred embodiment.

BRIEF DESCRIPTION OF THE DRAWINGS

The accompanying drawings and figures illustrate a number of exemplary embodiments and are part of the specification. Together with the present description, these drawings demonstrate and explain various principles of this disclosure. A further understanding of the nature and advantages of the present invention may be realized by reference to the following drawings. In the appended figures, similar components or features may have the same reference label.

DETAILED DESCRIPTION OF THE INVENTION

Figure 1:
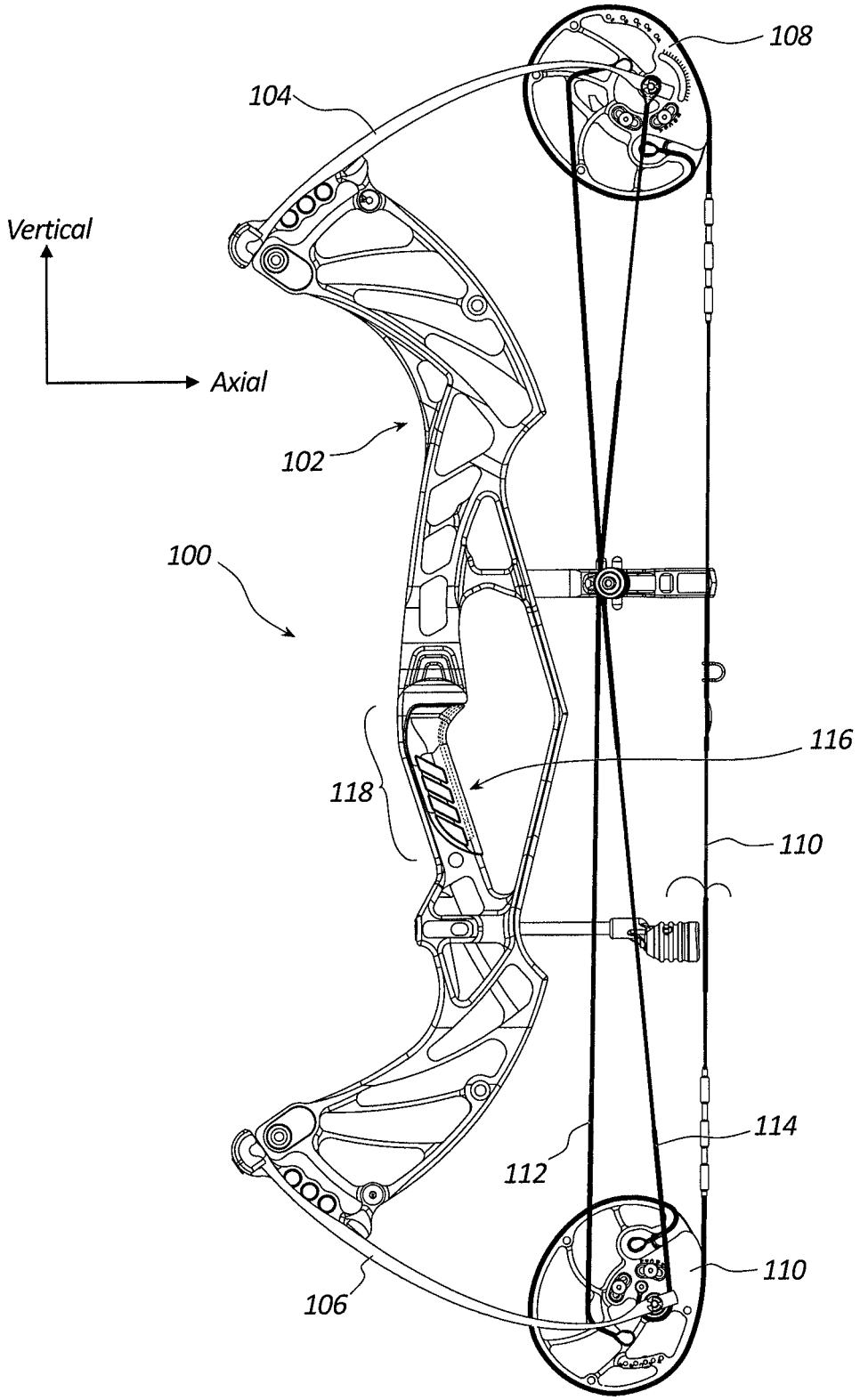
FIG. 1 is a side view of a bow according to an embodiment of the present disclosure.

The present disclosure generally relates to apparatuses, methods, and assemblies for attaching and adjusting archery bow grips. The way an archer grips the bow while shooting will impact how the arrow exits the bow during a shot. For example, an archer may grasp the bow too tightly or contact too much surface area of the archer's palm or fingers on the grip when releasing the bowstring, thereby inducing inadvertent torque (i.e., a rotational force) on the riser. The grip may also be centered on a position out of alignment with the flight plane of the projectile, so release of the bowstring can cause the bow to rotate and alter the path of the projectile. In another example, the grip can be purposely positioned offset from the center of the riser in order to induce a torque or force on the projectile that counters or cancels an undesirable torque or force applied by other portions of the bow (e.g., leaning cams, bent riser or limbs, askew arrow rests, cable guards, etc.). Adjusting the position of the grip relative to the center plane of the riser may help reduce or alleviate unwanted forces or torques on the arrow during the shot. By incrementally and laterally adjusting the grip relative to the center plane of the riser or the intended flight plane of the projectile, an archer can offset torque induced on the riser for a more consistent and accurate arrow launch.

In one aspect of the disclosure, a plate may be attachable to the handle portion of a riser at a plurality of laterally spaced apart positions. A fastener or multiple fasteners may extend through one or more of a plurality of grip adjustment apertures in the plate to rigidly attach the plate to the handle portion of the riser. Some of the grip adjustment apertures may be incrementally displaced from the centerline of the plate. Thus, when attached to the riser, the plate may remain attached to the riser in a position that is offset from the center plane of the riser, but that may be better configured to counteract or cancel unwanted torques or forces on the projectile. By attaching the grip to the plate, the grip may also be retained in a position that is offset from the center plane of the riser. In some embodiments, the plurality of grip adjustment apertures may comprise an elongated through-hole or a plurality of elongated through-holes that intersect the centerline of the plate. In other embodiments, the plurality of grip adjustment apertures may include a plurality of elongated through-holes positioned about opposite sides of the centerline of the plate. In yet other embodiments, the plurality of grip adjustment apertures may include round through-holes positioned on and about the centerline of the plate.

In some cases, the plate may be removably attached to the handle portion of the riser to provide adjustable control over the position of the grip relative to the center plane of the riser. For example, an archer may desire to incrementally increase the lateral displacement of the grip position by non-destructively removing the plate and adjusting the mounting position of the plate to fine tune the archery bow for consistent and predictable arrow launch. In another case, an archer may replace their current grip and then need to adjust the lateral position of the new grip to compensate for the change in torque induced by use of the new grip. In yet another case, the archer's grip may not induce torque on the bow but a laterally offset grip position may help to alleviate another issue causing inconsistent arrow flight (e.g., cam-lean, bent riser, pocket misalignment, etc.).

Any movement of the grip relative to the riser while the bow is being drawn and shot may cause accuracy and consistency issues. Thus, archery bow manufacturers must find ways of rigidly attaching the grip to the riser to prevent grip movement relative to the riser. To avoid grip movement while drawing the bow, some bow manufacturers rely on adhesives or multiple fasteners to sufficiently attach the grip to the riser. While multiple fasteners may adequately secure the grip, the added fasteners create additional costs in labor and parts for manufacturers. Likewise, bonded and integrated grips may limit the ability of manufacturers and customers to selectively remove, adjust, or replace the grip of their archery bow.

In another aspect of the disclosure, a grip may be rigidly attached to a riser. The handle portion of a riser may include a riser assembly having at least one riser mating protrusion protruding laterally from the handle portion of the riser assembly relative to the center plane of the riser. The riser mating protrusion can also be configured as a protrusion or elongated ridge extending laterally from a left- or right-facing side surface of the handle area of the riser when the bow is in a vertical or substantially upright position. The grip of an archery bow may have a riser contacting surface having a corresponding grip mating recess configured to receive the riser mating protrusion of the riser assembly to retain the grip to the riser. In one embodiment, the riser mating protrusion may be a linear or curved flange and the grip mating recess may be an elongated slot which receives the flange to attach the grip to the riser assembly. The handle portion of the riser assembly may include multiple riser mating protrusions positioned about opposite sides of the center plane of the riser, each riser mating protrusion being receivable by a corresponding grip mating recess.

In another example embodiment, the riser assembly may further include a plate which is attachable to the handle portion of the riser. The plate may have at least one riser mating protrusion configured to be received by a corresponding grip mating recess to receive and retain the grip. The grip may be attached to the riser assembly by aligning the riser mating protrusion with the grip mating recess and moving the grip in a direction that causes the riser mating protrusion to slide into and along the grip mating recess. The riser assembly may further include a fastener configured to extend through a portion of the grip to attach the grip to the plate, thereby increasing the rigidity of the attachment. Additionally, the use of a single fastener to attach the grip to the plate or riser can improve the aesthetic appearance of the grip and make the grip easier and quicker to exchange from the handle of the riser.

The grip may attach directly to the riser in other embodiments. For example, the handle portion of the riser may include a pair of riser mating protrusions protruding laterally out of the handle portion of the riser which may be receivable by a pair of corresponding grip mating recesses on a surface of the grip. The pair of riser mating protrusions may increase the width of the riser surface that contacts the grip. Thus, an intervening plate may not be required. A widened contact surface may act to increase the amount of torque required to rotate or otherwise move the grip relative to the riser.

The present description provides examples, and is not limiting of the scope, applicability, or configuration set forth in the claims. Thus, it will be understood that changes may be made in the function and arrangement of elements discussed without departing from the spirit and scope of the disclosure, and various embodiments may omit, substitute or add other procedures or components as appropriate. For instance, methods described may be performed in an order different from that described, and various steps may be added, omitted, or combined. Also, features described with respect to certain embodiments may be combined in other embodiments. In some cases, the present disclosure may be applied to compound bows, recurve bows, and traditional bows.

FIG. 1 shows an example archery bow 100. The archery bow 100 includes a riser 102, upper and lower limbs 104, 106 mounted to the riser 102, and first and second cams 108, 110 supported by the upper and lower limbs 104, 106, respectively. The archery bow 100 further includes a pair of cables 112, 114 and a bowstring 116 extended between the first and second cams 108, 110. The archery bow 100 being operated by grasping the riser 102 near a handle portion 118 and pulling or otherwise drawing the bowstring 116 in a rearward direction away from the riser 102. An adjustable grip 120 may be attached to the handle portion 118 of the riser 102.

Figure 2:
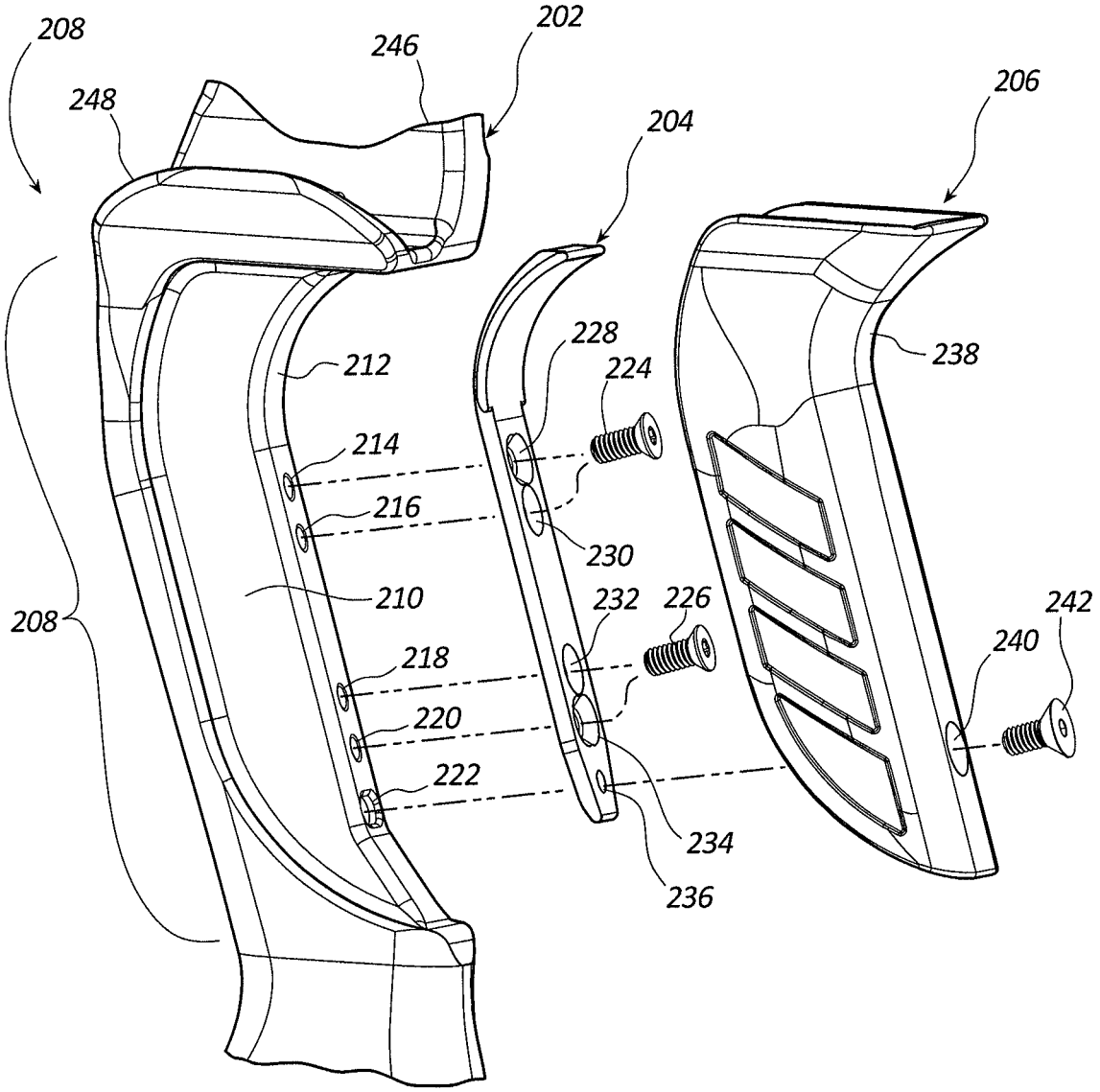
FIG. 2 is an exploded perspective view of a handle portion of a riser of the bow of FIG. 1.

FIG. 2 shows an exploded perspective view of a portion of a riser assembly 200 of the bow of FIG. 1. The riser assembly 200 may include a riser 202 corresponding to riser 102, a plate 204, and a grip 206 corresponding to grip 120, wherein the plate 204 is attachable to a handle portion 208 of the riser 202 at a plurality of laterally spaced apart positions relative to the center plane (see FIGS. 3-5) of the riser 202.

The riser 202 may include a grip interfacing surface 210 configured to contact an inner surface of the grip 206, and the riser 202 can include a plate interfacing surface 212 contoured to match the curvature of a generally forward-facing surface of the plate 204. The grip interfacing surface 210 may be configured to interface with the grip 206 when the grip 206 is installed onto the archery bow.

In some embodiments, the plate 204 may be completely covered, completely occluded, and enclosed by the grip 206 when the grip 206 is attached to the plate 204. The riser 202 may also include multiple bores 214, 216, 218, 220 that are each positioned on and aligned with the center plane of the riser 202 and configured to receive a fastener (e.g., one or more fasteners 224, 226). The riser 202 may also have a riser recess 222 configured to house a portion of a grip fastener 242 when the grip 206 is attached to the plate 204. In some embodiments, the riser recess 222 may be laterally elongated to allow the threaded portion of the grip fastener 242 to be positioned on or around the center plane of the riser 202 without contacting the riser 202 when the grip 206 is attached to the plate 204 (see FIG. 3A).

The plate 204 may have a plurality of grip adjustment apertures 228, 230, 232, 234. The plate may also include an aperture 236 configured to receive the grip fastener 242. In some embodiments, the plurality of grip adjustment apertures 228, 230, 232, 234 may vary in diameter, shape, and location. Similarly, the plurality of grip adjustment apertures 228, 230, 232, 234 may be partially recessed (e.g., chamfered) or otherwise machined into the plate 204 to accommodate fasteners of varying head types (e.g., rounded, flat, pan, socket, button, etc.).

The grip 206 may have a throat portion 238 and rear surface configured to interface with the archer's palm while gripping the riser 202. In some embodiments, the throat portion 238 may be contoured to match the rear curvature of the plate 204 or riser 202. The grip 206 may further include a grip mounting aperture 240 configured to permit a grip fastener 242 to extend through the grip 206. In some embodiments, the grip fastener 242 may extend through the grip mounting aperture 240 and thread into the aperture 236 of the plate 204 to attach the grip 206 to the plate 204.

In some embodiments, the fasteners 224, 226 are extended through at least one of the plurality of grip adjustment apertures 228, 230, 232, 234 of the plate 204 to removably but rigidly attach the plate 204 to the riser handle portion 208. The plurality of bores 214, 216, 218, 220 of the riser 202 may receive one or more fasteners 224, 226 extended through the plate 204 to securely retain the plate 204 to the riser 202. For example, the plurality of bores 214, 216, 218, 220 may be threaded to retain the fasteners 224, 226. A portion of the plurality of grip adjustment apertures 228, 230, 232, 234 of the plate 204 may be located some lateral distance from a centerline $C_L$ running longitudinally down the center of the plate 204. For example, as shown in FIGS. 4, 5, and 6, the elongated grip adjustment apertures 228, 234 can receive fasteners at positions offset from the centerline $C_L$ of the plate 204. Thus, the plate 204 may be attached to the handle portion 208 in a position where the vertical centerline $C_L$ of the plate 204 is laterally offset from the vertical center plane $C_P$ of the handle portion 208 of the riser 202. See FIGS. 4-5. Alternatively, the fasteners 224, 226 may be extended through a portion of the plurality of grip adjustment apertures 228, 230, 232, 234 positioned on the centerline $C_L$ of the plate 204 and thereby align the centerline $C_L$ of the plate 204 with the center plane $C_P$ of the handle portion 208 of the riser 202. See FIG. 3.

Figure 3:
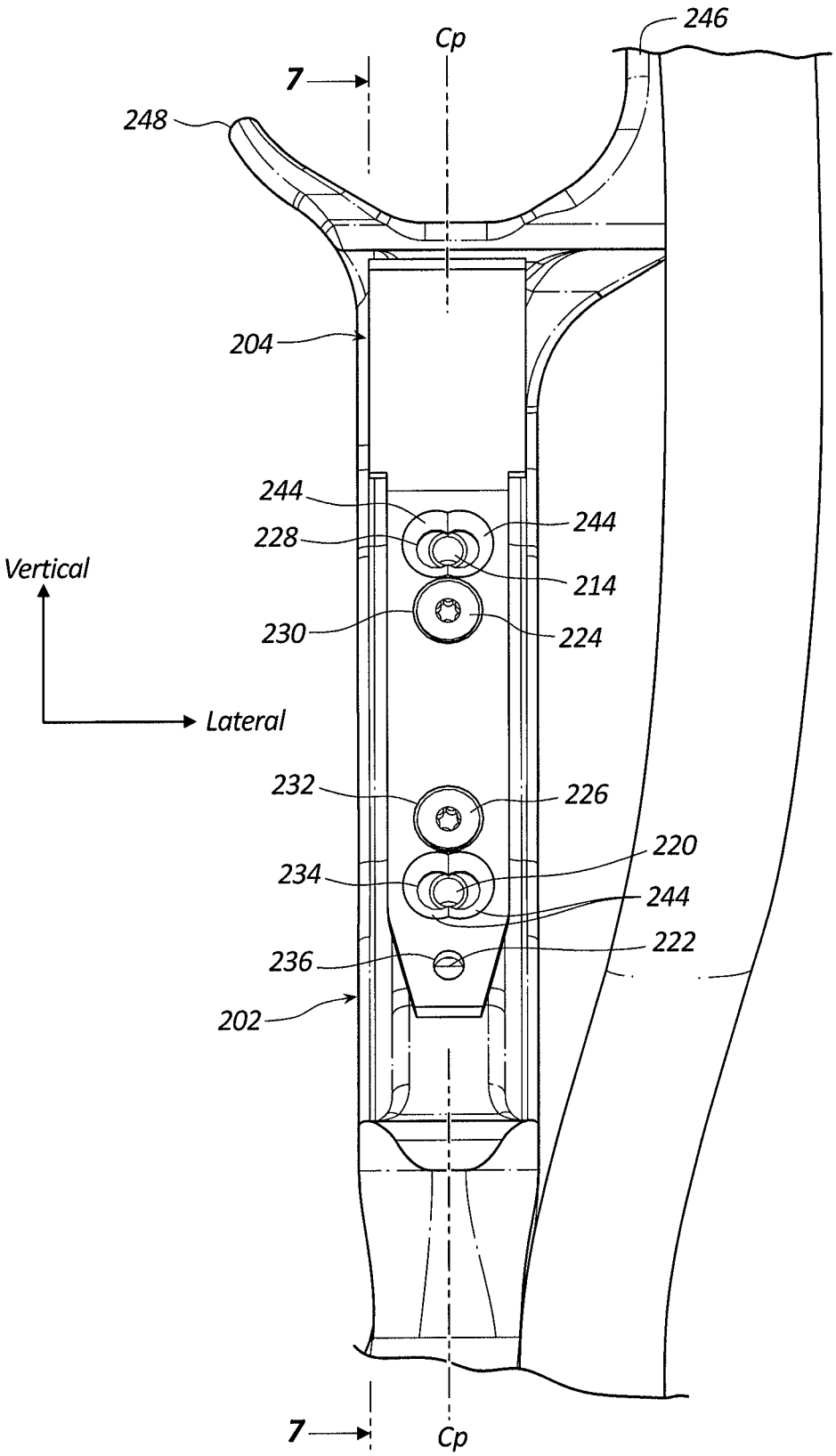
FIG. 3 is a rear view of a plate attached to a handle portion of a riser in a position which aligns a centerline of the plate with a center plane of the handle portion.
Figure 4:
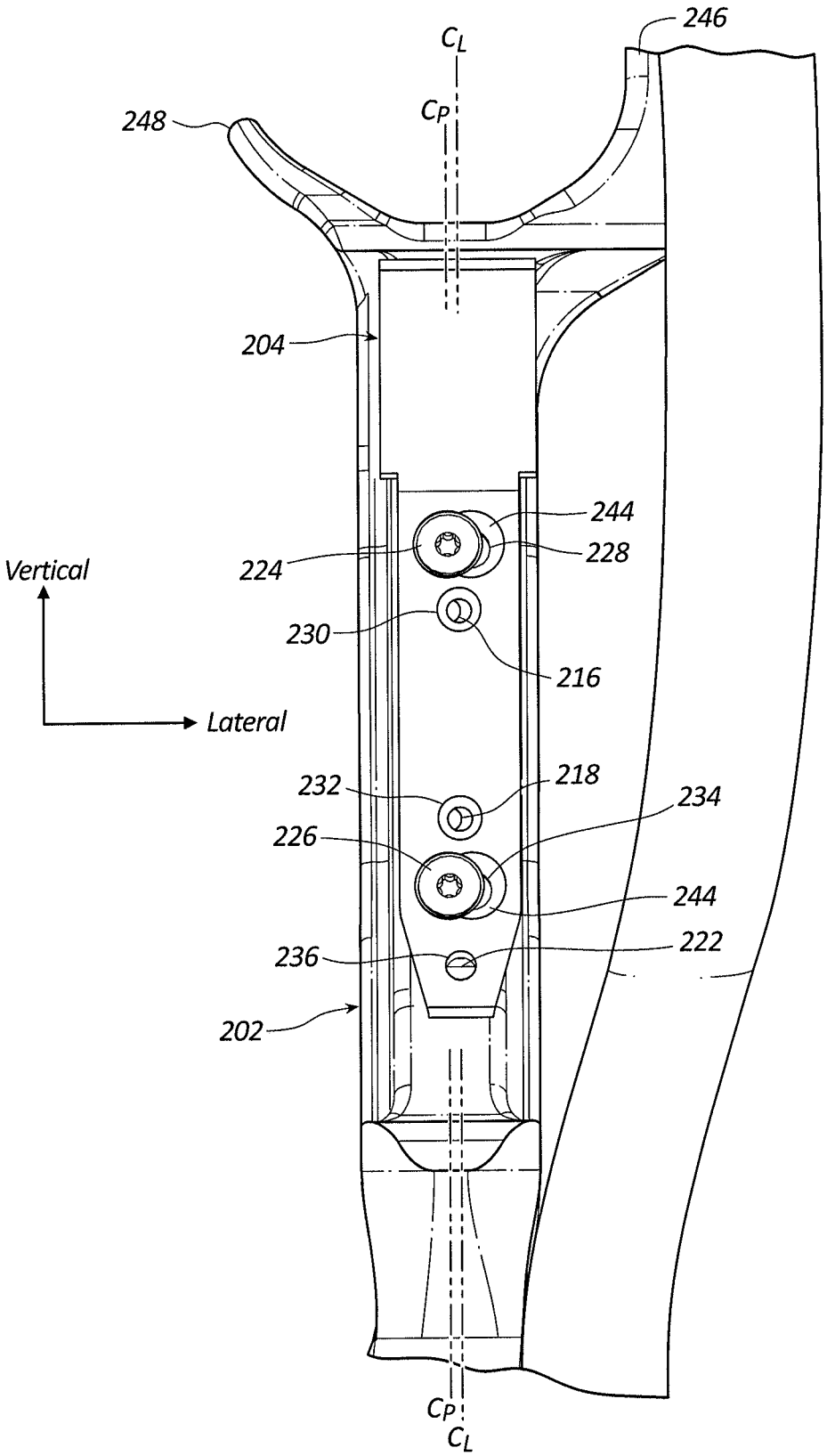
FIG. 4 is a rear view of a plate attached to a handle portion of a riser in a position which laterally offsets a centerline of the plate with a center plane of the handle portion.
Figure 5:
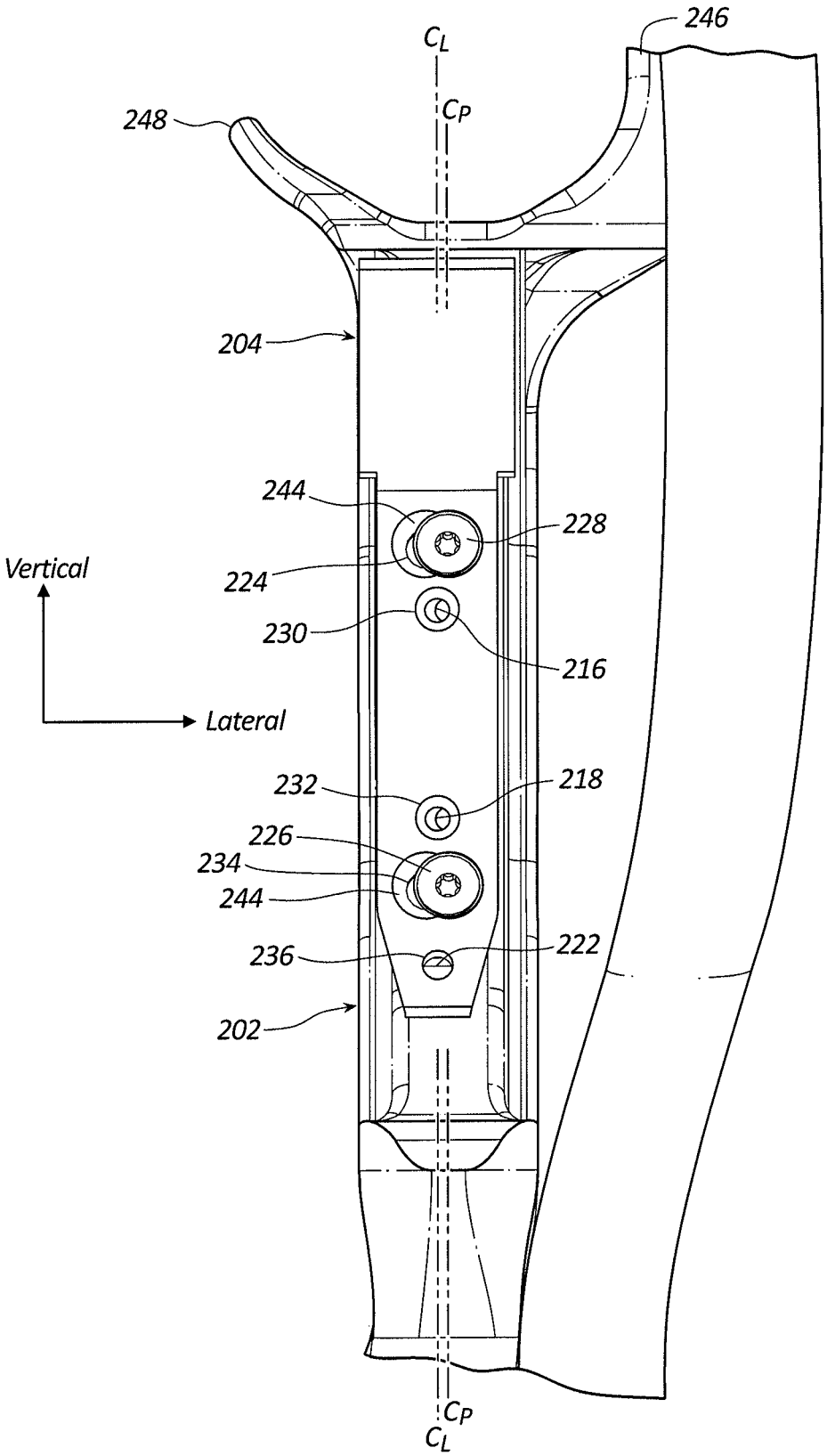
FIG. 5 is a rear view of a plate attached to a handle portion of a riser in another position which laterally offsets a centerline of the plate with a center plane of the handle portion.
Figure 6:
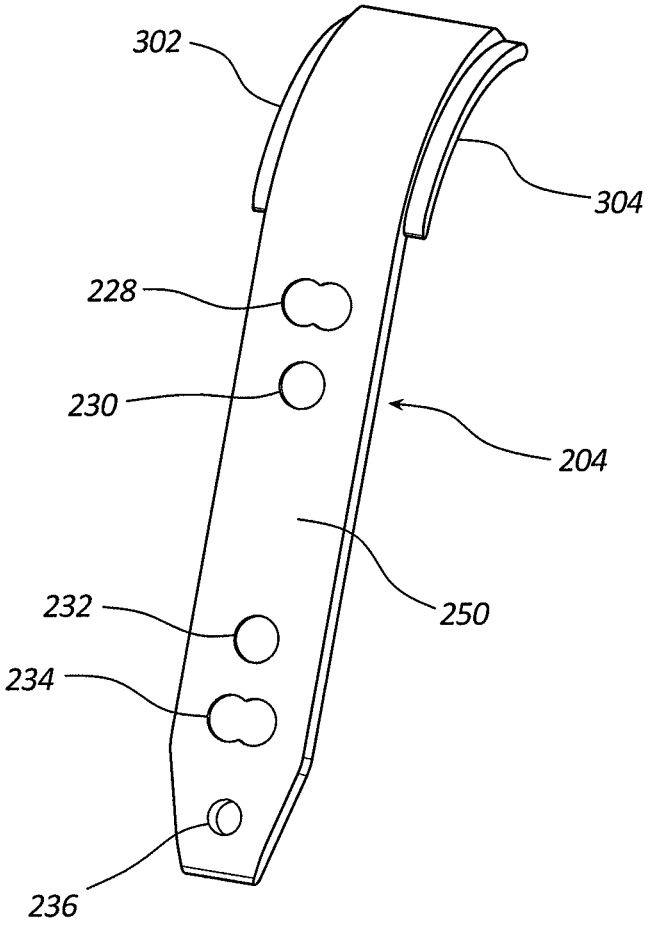
FIG. 6 is a perspective view of a plate for use in an archery bow.

FIGS. 3-5 show a rear view of the plate 204 attached to the riser 202 at various positions relative to the center plane $C_P$ of the handle portion 208 of the riser 202. In some embodiments, the plurality of grip adjustment apertures 228, 230, 232, 234 may comprise round grip adjustment apertures 230, 232 positioned on the centerline $C_L$ of the plate 204 and elongated grip adjustment apertures 228, 234 spanning longitudinally across the centerline $C_L$ of the plate 204. See also FIG. 6. The elongated grip adjustment apertures 228, 234 may have at least one recess 244 (i.e., at least one fastener-receiving position) centered on each side of the centerline $C_L$. Each recess 244 can locate the head of a fastener 224, 226 within one of the elongated grip adjustment apertures 228, 234. For example, the recess 244 may be a chamfer or a plurality of chamfers machined into a surface of the plate 204 which interfaces with the head of a fastener. In other embodiments, the recess 244 may be an elongated recess configured to receive the head of a fastener at a plurality of positions within the apertures 228, 234. The centerline $C_L$ of the plate 204 may be aligned with the center plane $C_P$ of the riser 202 when fasteners 224, 226 are extended through the round grip adjustment apertures 230, 232 and received by bores 216, 218 positioned on the center plane $C_P$ of the riser 202 (see FIG. 3). Alternatively, the centerline $C_L$ of the plate 204 may be laterally offset from the center plane $C_P$ of the riser 202 when fasteners 224, 226 are extended through the elongated grip adjustment apertures 228, 234 and received by bores 214, 220 positioned on the center plane $C_P$ of the riser 202 (see FIGS. 4-5).

FIG. 3 shows a rear view of a plate 204 attached to a riser 202, wherein a vertical or longitudinal centerline $C_L$ of the plate 204 is aligned with a center plane $C_P$ of the riser 202. In some embodiments, the plate 204 may be attached to the riser 202 by extending fasteners 224, 226 through round grip adjustment apertures 230, 232 positioned on the plate 204 to align the centerline $C_L$ of the plate 204 with the center plane $C_P$ of the riser 202. Thus, a grip (not shown) installed on the plate 204 may also be centrally aligned with the center plane $C_P$ of the riser 202. In some embodiments, a recess or aperture in the front of the grip can be centrally aligned with the centerline $C_L$ and the center plane $C_P$. The round grip adjustment apertures 230, 232 may be positioned on the centerline $C_L$ of the plate 204. In other embodiments, a single fastener may be extended through a single grip adjustment aperture to attach the plate 204 to the riser 202. In various embodiments, any number of fasteners and apertures of various shapes and sizes can be positioned in a plurality of positions on the plate 204. A set or plurality of the grip adjustment apertures 228, 230, 232, 234 may remain unused depending on the desired position of the plate 204 relative to the riser 202. For example, a pair of fasteners 224, 226 may only extend through the round grip adjustment apertures 230, 232 when a grip position is desired that aligns the centerline $C_L$ of the plate 204 with the center plane $C_P$ of the riser 202, in which case the elongated grip adjustment apertures 228, 234 may remain empty or otherwise unused to attach the plate 204 to the riser 202. Similarly, the elongated grip adjustment apertures 228, 234 can be used while the round group adjustment apertures 230, 232 are empty.

Figure 3A:
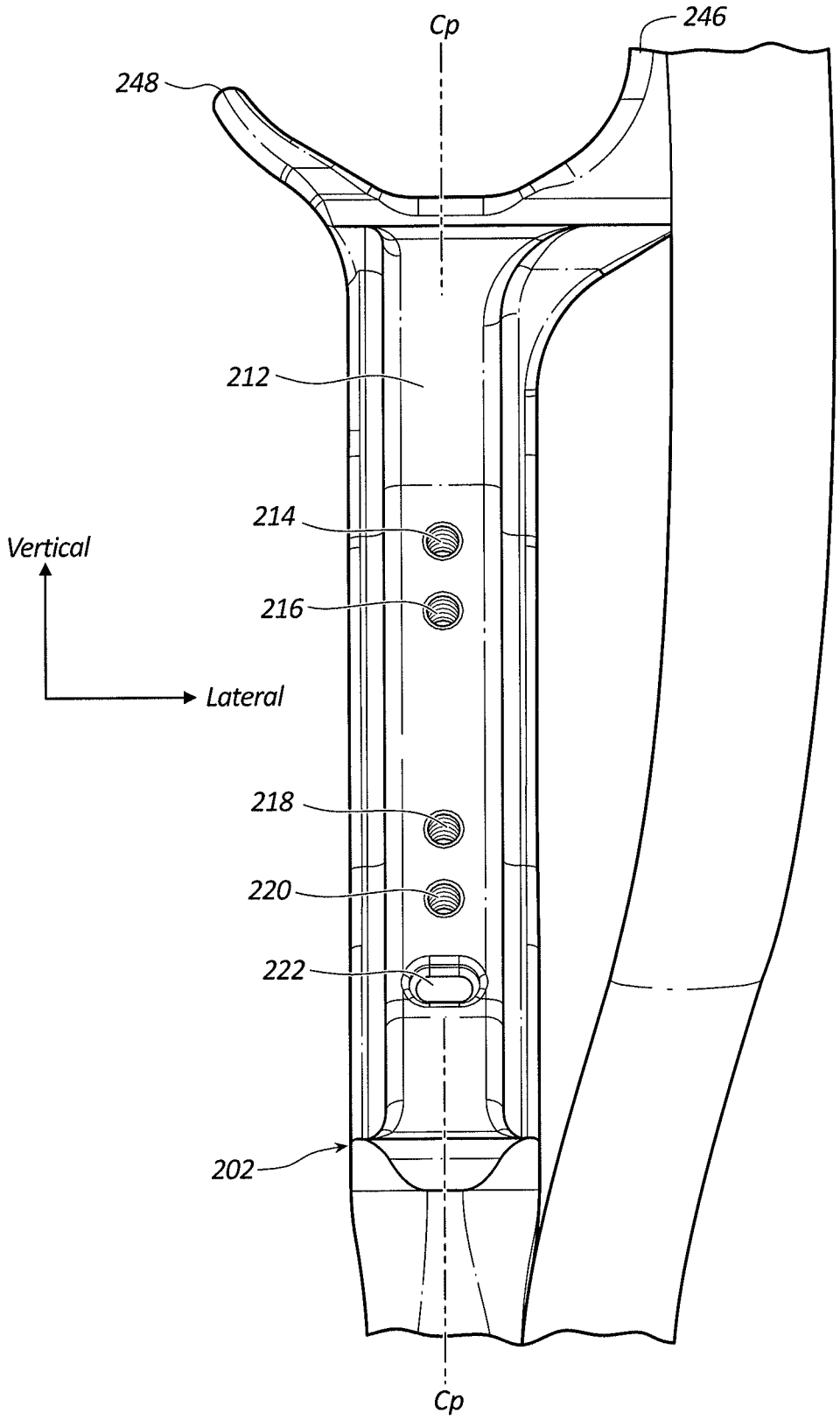
FIG. 3A is a rear view of multiple bores and a riser recess within a handle portion of a riser.

FIG. 3A shows a rear view of a riser 202 having multiple bores 214, 216, 218, 220 and a riser recess 222. The multiple bores 214, 216, 218, 220 may receive a fastener (e.g., one or more fasteners 224, 226) to retain the plate 204 to the plate interfacing surface 212 of the riser 202. In one embodiment, the multiple bores 214, 216, 218, 220 may be positioned to align with the center plane $C_P$ of the handle portion 208 of the riser 202. The riser recess 222 in the plate interfacing surface 212 of the riser 202 may accommodate and receive the end of the grip fastener 242 when the grip fastener 242 is extended through the plate 204. In some embodiments, the riser recess 222 may be elongated to allow a threaded portion of the grip fastener 242 to occupy a portion of the riser recess 222 without contacting the plate interfacing surface 212 of the riser 202 when the plate 204 is retained in a position laterally offset from the center plane $C_P$ of the riser 202. For example, the plate 204 may be attachable to the riser 202 in a plurality of laterally offset positions which require an elongated riser recess 222 to prevent the grip fastener 242 from contacting the plate interfacing surface 212 of the riser 202 (see FIGS. 4 and 5).

FIG. 4 shows a rear view of a plate 204 attached to a riser 202, wherein a centerline $C_L$ of the plate 204 is laterally offset from a center plane $C_P$ of the handle portion 208 of the riser 202 to the right-hand side of the bow 100 (e.g., in a lateral direction toward a rest mount 246 of the riser 202). In some embodiments, fasteners 224, 226 are positioned through the elongated grip adjustment apertures 228, 236 at a position that is offset from the centerline $C_L$ of the plate 204 to attach the plate 204 to the riser 202. Thus, a grip (not shown) installed on the plate 204 may be retained to the handle portion 208 at a position offset from the center plane $C_P$ of the handle portion 208 of the riser 202. In some embodiments, the elongated grip adjustment apertures 224, 226 may each be a single, continuous, elongated aperture having within it multiple positions through which a fastener may be positioned. In other cases, the plate 204 can comprise a plurality of distinct and separate apertures positioned on opposite lateral sides of the centerline $C_L$ of the plate 204, wherein a fastener can be selectively installed into each one of the individual openings to attach the plate 204 at different positions relative to the handle portion 208. In other embodiments, multiple elongated grip adjustment apertures 244 may be positioned in the plate 204 on opposite sides of the centerline $C_L$ of the plate 204.

FIG. 5 shows a rear view of a plate 204 attached to a riser 202, wherein a centerline $C_L$ of the plate 204 is laterally offset from a center plane $C_P$ of the handle portion of the riser 202 on a left side of the riser 202 (i.e., toward an arrow shelf 248 extending from the left side of the riser 202). In some embodiments, fasteners 224, 226 are extended through the elongated grip adjustment apertures 228, 234 at a position that is offset from the centerline $C_L$ of the plate 204 to attach the plate 204 to the riser 202. Thus, a grip (not shown) installed on the plate 204 may be retained in a position offset from the center plane $C_P$ of the handle portion 208 of the riser 202 to the left side of the center plane $C_P$.

With the plate 204 and grip 206 offset to the left side of the center plane $C_P$ as shown in FIG. 4, the archer's hand on the grip 206 can induce a torque on the bow that is clockwise around the vertical longitudinal axis of the bow when viewed from above. When the plate 204 and grip 206 are offset to the right side of the center plane $C_P$ as shown in FIG. 5, the archer's hand on the grip 206 can induce a torque in the opposite direction (i.e., counter-clockwise when viewed from above). A centered plate 204 and grip 206, as shown in FIG. 3, can apply no torque or a reduced torque as compared to the other offset positions. Thus, the plate 204 can provide three different laterally offset positions for the grip 206 relative to the handle portion 208. In embodiments with a continuous extended slot aperture in the plate 204 (e.g., in the place of apertures 228 and 234), the plate 204 (and therefore the grip 206 when attached to the plate 204) can be attached to the handle portion 208 at an infinite number of laterally different positions.

FIG. 6 shows a perspective view of a riser interfacing surface 250 of a plate 204 for use in an archery bow. The plate 204 may include a riser interfacing surface 250 having linear and curved portions which match the contours of a handle portion (not shown) of a riser (not shown) where the archer grips the bow. In some embodiments, the plate 204 may include a plurality of grip adjustment apertures 228, 230, 232, 234 and a grip mounting aperture 236 extending through the plate 204. The plurality of grip adjustment apertures 228, 230, 232, 234 may be positioned on and about a longitudinal centerline $C_L$ of the plate 204.

Figure 9:
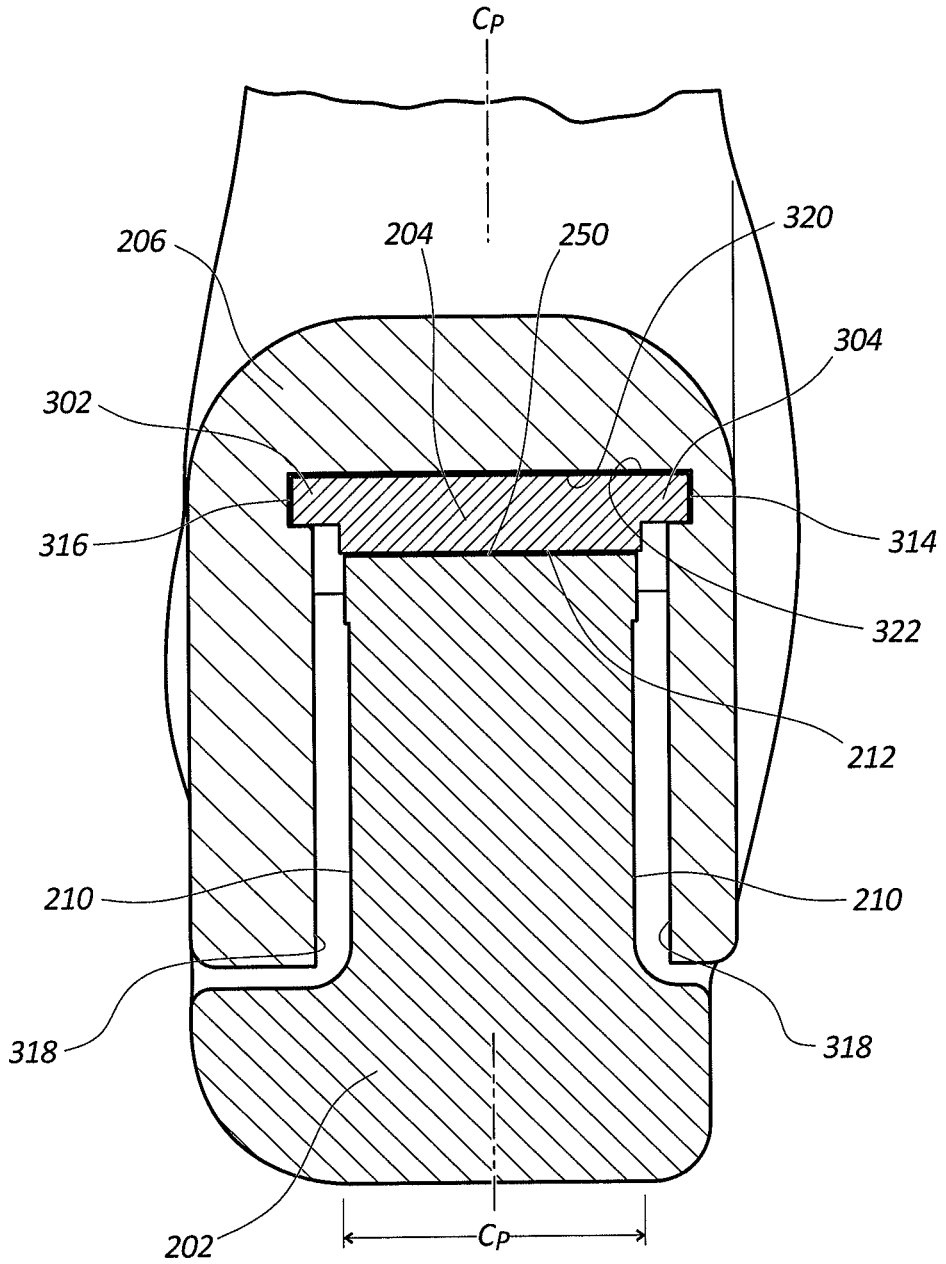
FIG. 9 shows a top section view of a riser assembly, where the section is taken through lines 9-9 in FIG. 8.

The plate 204 may also include at least one riser mating protrusion (e.g., one or more riser mating protrusions 302, 304) protruding laterally relative to the centerline $C_L$ of the plate 204. The cross-sectional profile of a riser mating protrusion 302, 304 may include various shapes. For example, the cross section of a riser mating protrusion 302, 304 may be a square or rectangle as shown in FIG. 9. Alternatively, the riser mating protrusions 302, 304 may have a round or semi-circular cross section in another embodiment. It should be appreciated that the cross section of a riser mating protrusion 302, 304 may include a variety of shapes having a combination of linear and curved surfaces. Moreover, the cross section of a riser mating protrusion 302, 304 may vary in shape relative to the longitudinal axis of the protrusion. For example, the a cross section at one portion of a riser mating protrusion may be square while the cross section at another portion of the same riser mating protrusion may be triangular. The riser mating protrusions 302, 304 can be configured with a thickness less than or equal to the thickness of the center of the plate 204. An end of the riser mating protrusion 302, 304 may be narrower than a central portion or opposite end of the riser mating protrusion 302, 304 to ease insertion of the riser mating protrusion 302, 304 into a groove or opening in the grip 206.

Figure 7:
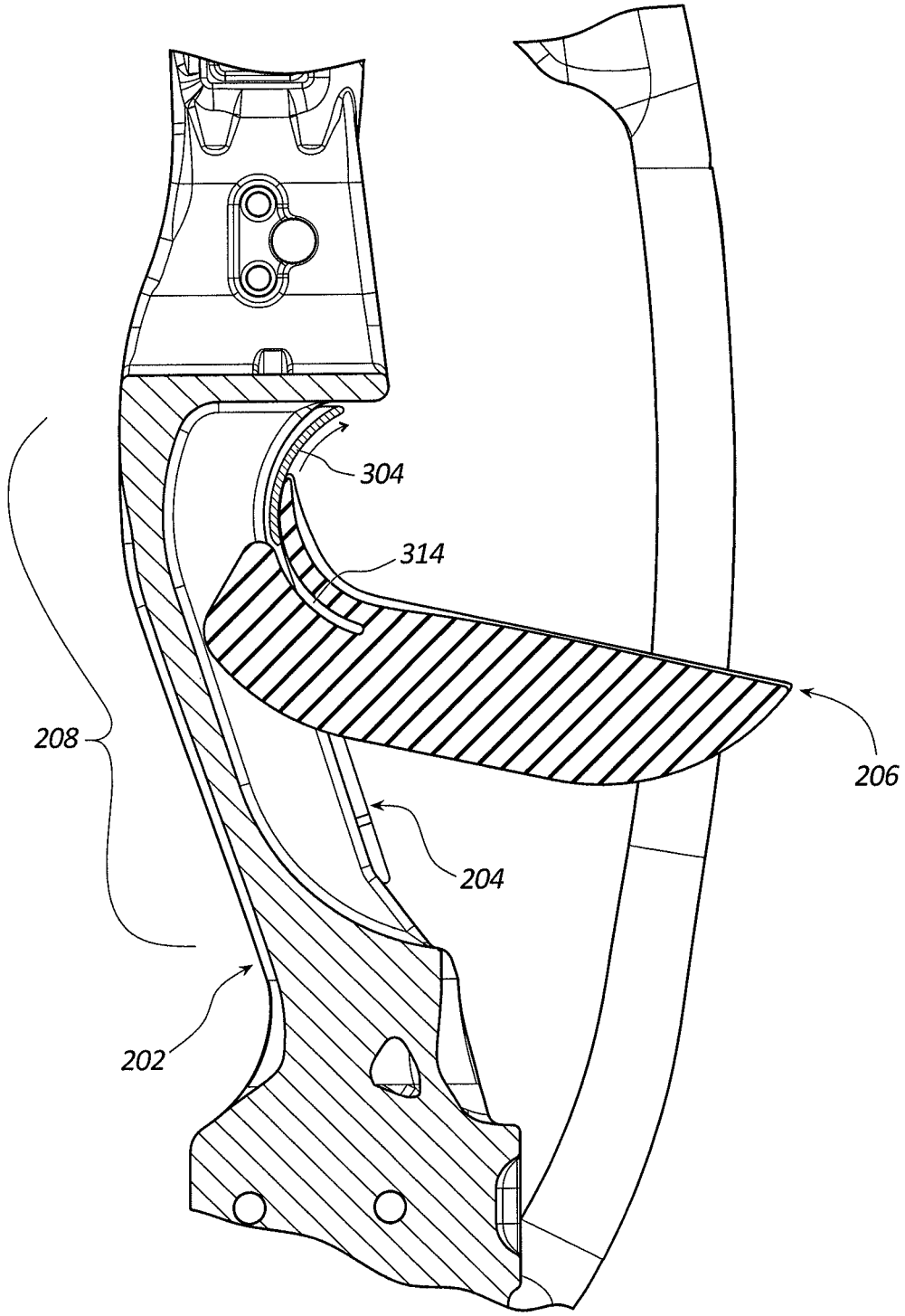
FIG. 7 is a section view of a grip being installed on a plate attached to a handle portion of a riser, where the section is taken through lines 7-7 in FIG. 3.
Figure 8:
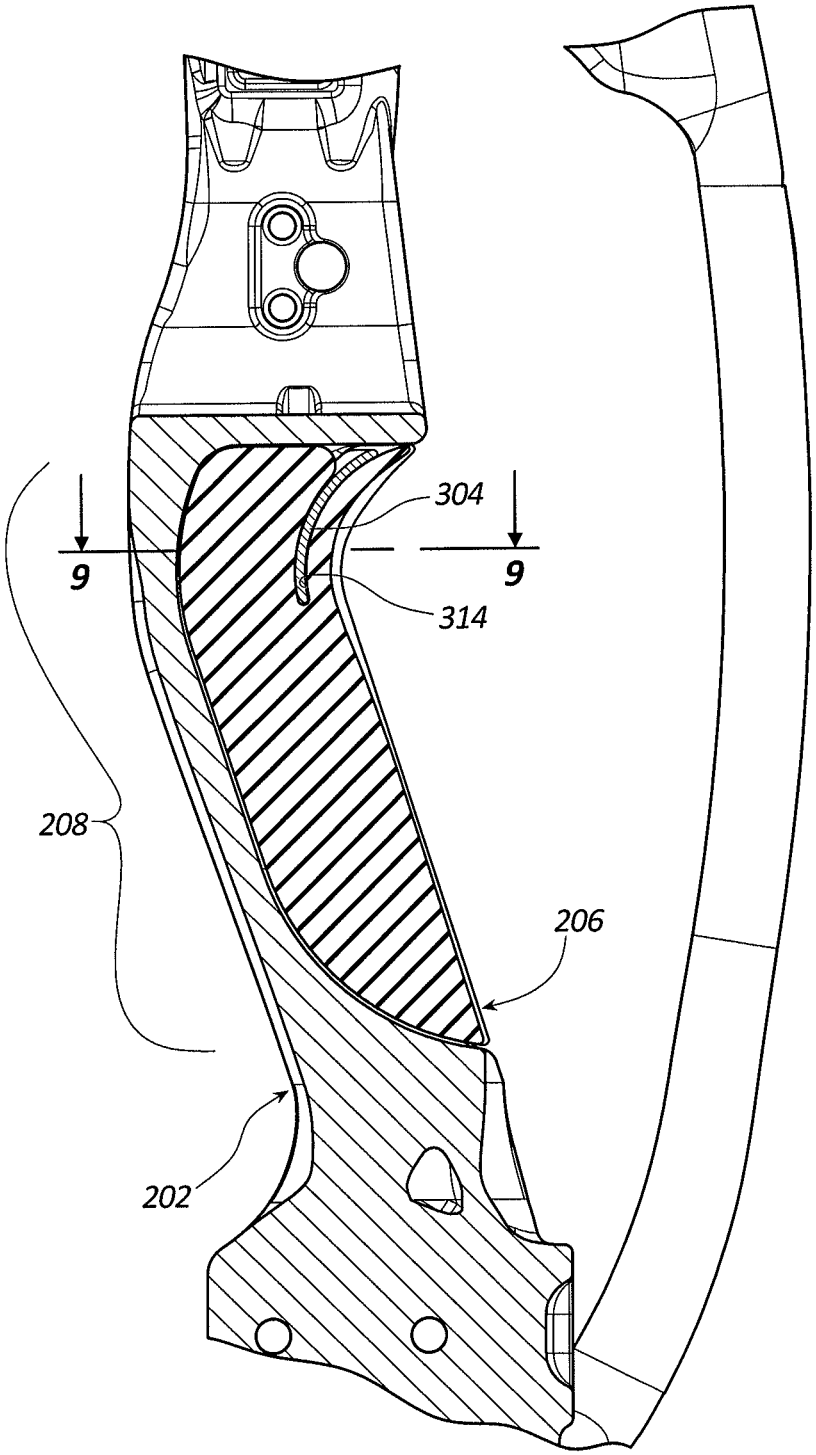
FIG. 8 is a section view of a grip installed on a plate attached to a handle portion of a riser, where the section is taken through lines 7-7 in FIG. 3.

In one embodiment, the riser mating protrusions 302, 304 may each be a single elongated protrusion or flange spanning some curved upper portion of a side of the plate 204. In other embodiments, the riser mating protrusions 302, 304 may be a series of protrusions extending laterally from one or more sides of the plate 204 in a line or along a smooth curve (e.g., the curved shape of the top end of the plate 204). FIG. 7-8 show a section view of a grip 206 at different stages of installation to a plate 204 attached to a handle portion 208 of a riser 202. A riser mating protrusion 304 may be received in a corresponding grip mating recess 314 positioned within the riser contacting surface of the grip 206. See also FIG. 9. The view of FIG. 7 shows the protrusion 304 at the entrance to the grip mating recess 314, and the view of FIG. 8 shows the protrusion 304 fully inserted into the grip mating recess 314. The riser mating protrusion 304 may be inserted into and move within a corresponding slot on a surface of the grip 206. The riser mating protrusion 304 may include a tapered end (e.g., the bottom end) configured to ease insertion of the riser mating protrusion 304 into the grip mating recess 314.

The grip mating recess 314 may be a slot in the grip 206 configured to receive and retain a flange. In some embodiments, the riser mating protrusion 304 may be long enough to occupy the entirety of the length of the grip mating recess 314 when the grip 206 is attached to the riser 202, as shown in FIG. 8. In other embodiments, the riser mating protrusion 304 may only occupy a portion of the grip mating recess 314 when the grip 206 is attached to the riser 202. In yet other embodiments, a plurality of riser mating protrusions may occupy a plurality of grip mating recesses in varying proportions.

In some embodiments, the riser mating protrusions 304 may extend or protrude laterally from a handle portion 208 of a riser assembly relative to a center plane of the handle portion 208. For example, a single riser mating protrusion 304 may extend laterally from a handle portion 208 of a riser 202 and may be received by a corresponding grip mating recess 314 of the grip 206 without the use of a plate 204 between the grip 206 and the riser 202. Alternatively, a pair of riser mating protrusions may laterally extend from opposite sides of a center plane of the handle portion 208 of a riser 202 and corresponding grip mating recesses on the surface of the grip 206 may be configured to receive the pair of riser mating protrusions.

In another embodiment, the plate 204 may be securely attached to the handle portion 208 of the riser 202. The grip 206 may be attached to the plate 204 by aligning the tapered end of the riser mating protrusion 304 with the grip mating recess 314 (see FIG. 7) and translating and rotating the grip 206 such that the riser mating protrusion 304 moves within and is received by the grip mating recess 314 (see FIG. 8). In some embodiments, the riser mating protrusion 304 may be stopped within the grip mating recess 314 by contacting an inner surface of the grip mating recess 314. The grip 206 may also be prevented from further movement relative to the handle portion 208 by coming into contact with the plate 204 or handle portion 208. In some embodiments, the grip 206 may be attached to the plate 204 using a grip fastener 242 extended through the grip 206 and received by a grip aperture located on the plate 204.

FIG. 9 is a section view showing one embodiment of how a grip 206 may be attached to a plate 204 using riser mating protrusions 302, 304 and grip mating recesses 314, 316. A riser 202 may have a plate interfacing surface 212 and grip interfacing surfaces 210. The grip interfacing surfaces 210 may contact the riser contacting surfaces 318 of the grip 206 when the grip 206 is attached to the archery bow. The plate interfacing surface 212 may contact a riser interfacing surface 250 of the plate 204 when the plate 204 is attached to the riser 202. A portion of a rearward facing surface 322 of the plate 204 may contact a portion of a forward facing surface 320 of the grip 206. In some embodiments, the plate 204 may be completely enclosed between the riser 202 and the grip 206, such that the plate 204 may not be visible to an archer when the grip 206 is attached to the plate 204.

In an example embodiment, the grip 206 may include the riser contacting surface 318 having grip mating recesses 314, 316 configured to receive riser mating protrusions 302, 304 protruding from the plate 204. The riser mating protrusions 302, 304 may protrude laterally from the riser 202 relative to a center plane $C_P$ of the riser 202. The riser mating protrusions 302, 304 may be positioned on opposing sides of the center plane $C_P$ of the handle portion 208 of the riser 202. The thickness of the riser mating protrusions 302, 304 may be less than the thickness of the plate 204 in some embodiments See FIGS. 6 and 9. In other embodiments, the width of the riser mating protrusions 302, 304 may be greater than or equal to the thickness of the plate 204.

The center plane $C_P$ of the handle portion may be defined as a plane that intersects the midpoint between the grip interfacing surface 210 on the left side of the riser (i.e., closest to the arrow shelf 248 in FIGS. 3-5) and the grip interfacing surface 210 on the right side of the riser (i.e., closest to the rest mount 246 in FIGS. 3-5).

Various inventions have been described herein with reference to certain specific embodiments and examples. However, they will be recognized by those skilled in the art that many variations are possible without departing from the scope and spirit of the inventions disclosed herein, in that those inventions set forth in the claims below are intended to cover all variations and modifications of the inventions disclosed without departing from the spirit of the inventions. The terms "including:" and "having" come as used in the specification and claims shall have the same meaning as the term "comprising."

What is claimed is:

1. An archery bow, comprising:

a riser assembly having an upper end, a lower end, and a handle portion;

a grip having a riser contacting surface and a throat portion located and configured to interface with an archer's palm;

at least one protrusion extending laterally from either the handle portion or the grip, the handle portion or the grip forming the at least one protrusion;

at least one recess extending into either the handle portion or the grip;

the protrusion and the recess mating with each other, the grip concealing the protrusion and the recess while the protrusion and the recess are mated with each other;

an upper limb and a lower limb, each limb having a proximal end and a distal end, the proximal ends of the upper and lower limbs being connected to the respective upper and lowers ends of the riser assembly.

2. The archery bow of claim 1, wherein the at least one protrusion is a flange.

3. The archery bow of claim 1, wherein the recess is an elongated slot.

4. The archery bow of claim 1, wherein the recess spans a length equal to a length of the protrusion.

5. The archery bow of claim 1, further comprising a plurality of protrusions positioned on opposite sides of a center plane of the handle riser assembly.

6. The archery bow of claim 1, wherein the riser assembly further comprises a plate attachable to the handle portion, wherein the plate comprises the protrusion extending laterally from a centerline of the plate and is configured to be received by the recess formed in the grip to retain the grip on the riser assembly.

7. The archery bow of claim 1, wherein the mating of the protrusion and the recess limits relative movement of the riser assembly and the grip in either a vertical direction or a horizontal direction.

8. The archery bow of claim 1, wherein the protrusion and the recess mate in a radial manner to limit relative movement of the riser assembly and the grip in either a horizontal direction or a vertical direction.

9. The archery bow of claim 1, wherein the throat portion of the grip is contoured to match a rear curvature of the handle portion.

10. An adjustable grip system for an archery bow, comprising:

a riser having an upper end, a lower end, and a handle portion positioned between the upper end and the lower end;

a plate including a forward-facing surface and a rearward-facing surface, the plate having at least one grip adjustment aperture extending from the forward-facing surface to the rearward-facing surface;

a fastener configured to extend through the at least one grip adjustment aperture of the plate to attach the plate to the handle portion, wherein the plate is attachable to the handle portion by the fastener at a plurality of laterally spaced apart positions;

a grip attachable to the plate.

11. The adjustable grip system of claim 10, wherein the plate comprises a centerline, wherein in a first position of the plurality of laterally spaced apart positions, the centerline is offset from a center plane of the handle portion in a first direction and wherein in a second position of the plurality of laterally spaced apart positions, the centerline is offset from the center plane of the handle portion in a second direction, the second direction being opposite the first direction.

12. The adjustable grip system of claim 10, wherein the at least one grip adjustment aperture comprises an elongate slot extending across a centerline of the plate.

13. The adjustable grip system of claim 10 further comprising a second fastener, the first and second fasteners being configured to extend through separate grip adjustment apertures.

14. The adjustable grip system of claim 10, wherein the plate includes a centerline, the centerline of the plate being parallel to a center plane of the handle portion.

15. The adjustable grip system of claim 10, wherein the plate further comprises at least one lateral protrusion and the grip further comprises at least one grip recess configured to receive the lateral protrusion of the plate to retain the grip to the plate.

16. A method for adjusting an archery bow grip, comprising:

mounting a plate to a handle portion of a riser of an archery bow using a fastener, the plate including a forward-facing surface and a rearward-facing surface, the plate having an aperture extending from the forward-facing surface to the rearward-facing surface, the fastener extending through the aperture of the plate at one of a plurality of positions relative to the plate, wherein the plate is mounted at one of a plurality of lateral positions relative to a center plane of the handle portion;

attaching a grip to the plate.

17. The method of claim 16, wherein a centerline of the plate in a first mounting position on the handle portion and a centerline of the plate in a second mounting position on the handle portion are positioned on opposite sides of the center plane.

18. The method of claim 16, wherein a centerline of the plate in a first mounting position on the handle portion and a centerline of the plate in a second mounting position on the handle portion are positioned on the same side of the center plane.

19. The method of claim 16, wherein the plate is mounted to the handle portion such that a centerline of the plate is laterally spaced from the center plane of the handle portion.

20. The method of claim 16, wherein the plate is mounted to the handle portion using a plurality of fasteners extending through the plate.

21. The method of claim 16, wherein the plate further comprises at least one lateral protrusion and the grip further comprises at least one grip recess configured to receive the lateral protrusion of the plate to attach the grip to the plate.

22. The method of claim 16, wherein attaching the grip to the plate includes extending a fastener through the grip and receiving the fastener within the plate.

23. The method of claim 16, wherein the aperture comprises a slot, the fastener extending through the slot to mount the plate at one of the plurality of lateral positions relative to the center plane of the handle portion.

* * * * *